US012221853B2

(12) United States Patent
Molzahn

(10) Patent No.: US 12,221,853 B2
(45) Date of Patent: Feb. 11, 2025

(54) DOWNHOLE PLUG

(71) Applicant: Revolution Strategic Consulting Inc., Edmonton (CA)

(72) Inventor: Chris Molzahn, Edmonton (CA)

( * ) Notice: Subject to any disclaimer, the term of this patent is extended or adjusted under 35 U.S.C. 154(b) by 0 days.

(21) Appl. No.: 18/204,902

(22) Filed: Jun. 1, 2023

(65) Prior Publication Data

US 2023/0392469 A1 Dec. 7, 2023

Related U.S. Application Data

(60) Provisional application No. 63/347,991, filed on Jun. 1, 2022.

(51) Int. Cl.

| | |
|---|---|
| ***E21B 33/128*** | (2006.01) |
| ***E21B 33/12*** | (2006.01) |
| ***E21B 33/129*** | (2006.01) |
| ***E21B 33/134*** | (2006.01) |

(52) U.S. Cl.
CPC ..... *E21B 33/128* (2013.01); *E21B 33/1208* (2013.01); *E21B 33/129* (2013.01); *E21B 33/134* (2013.01)

(58) Field of Classification Search
CPC ... E21B 33/1208; E21B 33/128; E21B 33/134
See application file for complete search history.

(56) References Cited

U.S. PATENT DOCUMENTS

| | | | |
|---|---|---|---|
| 3,385,679 | A | 5/1968 | Current |
| 5,390,737 | A | 2/1995 | Jacobi et al. |
| 6,425,442 | B1 | 7/2002 | Latiolais, Jr. et al. |
| 7,373,973 | B2 | 5/2008 | Smith et al. |
| 7,600,572 | B2 | 10/2009 | Slup et al. |
| 7,735,549 | B1 | 6/2010 | Nish et al. |
| 8,336,616 | B1 | 12/2012 | McClinton |
| 8,561,689 | B2 | 10/2013 | Nutley et al. |
| 10,119,359 | B2 | 11/2018 | Frazier |
| 11,028,666 | B2 | 6/2021 | Sommers |
| 11,035,188 | B2 | 6/2021 | Morland |
| 11,136,855 | B2 | 10/2021 | VanLue |
| 11,236,576 | B2 | 2/2022 | Hardesty |

(Continued)

FOREIGN PATENT DOCUMENTS

| | | | |
|---|---|---|---|
| GB | 2296520 | A | 7/1996 |
| GB | 2377962 | B | 3/2003 |

*Primary Examiner* — Caroline N Butcher
(74) *Attorney, Agent, or Firm* — Nathan V. Woodruff

(57) ABSTRACT

A downhole plug, has an inner mandrel and a sealing assembly carried on and surrounding an outer surface of the inner mandrel. The sealing assembly is positioned between a lower support downstream of the sealing assembly and a setting shoulder upstream of the sealing assembly. The sealing assembly is activated from a deactivated state to a sealing state by causing the setting shoulder and the lower support to apply a compressive force to the sealing assembly such that an elastomeric seal extrudes outward into sealing engagement with an inner surface of a tubular. The lower support has a series of expandable segments mounted by a frangible connection, such that, as the compressive force is applied, the expandable segments break away from the lower support and move outward into engagement with the inner surface of the tubular.

6 Claims, 9 Drawing Sheets

(56) References Cited

U.S. PATENT DOCUMENTS

| | | | | |
|---|---|---|---|---|
| 2015/0060085 | A1* | 3/2015 | Xu | E21B 33/12<br>166/376 |
| 2016/0369586 | A1 | 12/2016 | Morehead et al. | |
| 2017/0138139 | A1* | 5/2017 | Hern | E21B 29/06 |

* cited by examiner

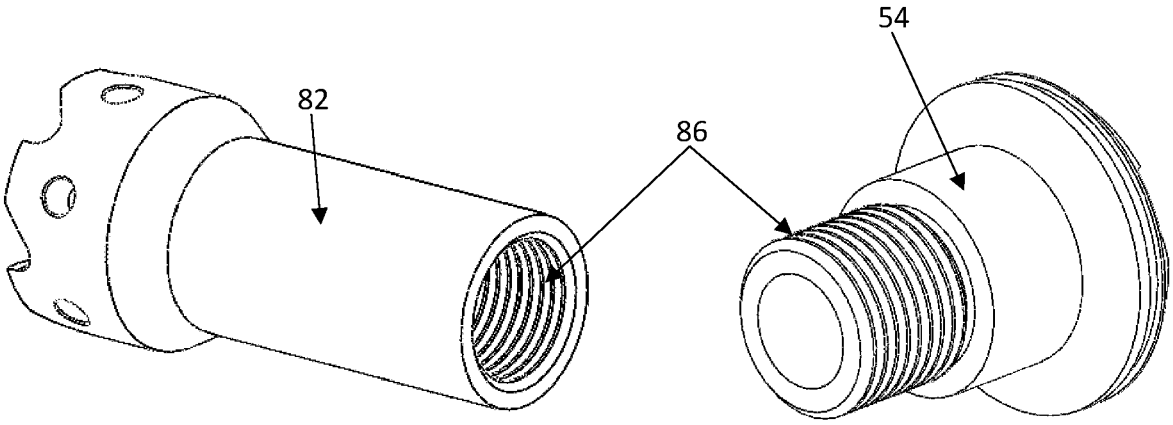
FIG. 17
FIG. 18
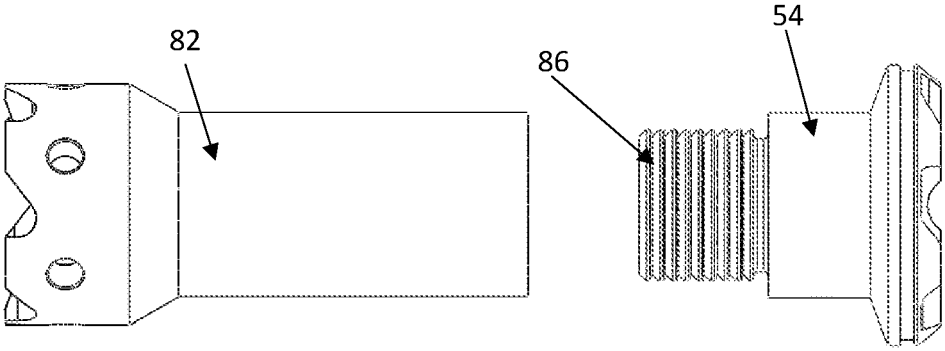
FIG. 19
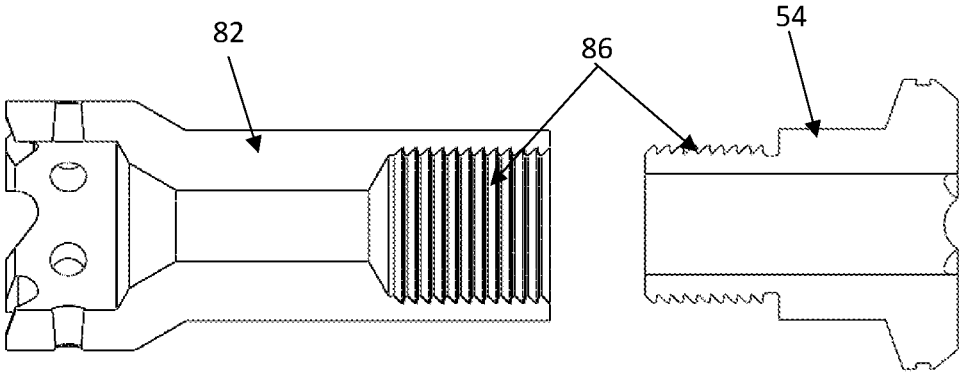
FIG. 20

DOWNHOLE PLUG

TECHNICAL FIELD

This relates to a downhole plug and in particular, a downhole plug with expandable seals and slips.

BACKGROUND

Downhole plugs are often used for well control or for downhole operations such as hydraulic fracturing operations, in which case they may also be referred to as a frac plug, bridge plug, or a packer. Frac plugs are lowered to a desired location within the well, typically using wireline or continuous tubing, and are then activated to isolate zones in a well. A common activation technique is to compress the plug, which causes gripping elements and elastomeric seals to expand outward to mechanically anchor the plug in place, and seal against fluid pressure. U.S. Pat. No. 9,309,744 (Frazier) entitled "Bottom set downhole plug" is an example of a downhole plug that may be used in a hydraulic fracturing operation.

SUMMARY

According to an aspect, there is provided a downhole plug, comprising an inner mandrel and a sealing assembly carried on and surrounding an outer surface of the inner mandrel. The sealing assembly may be positioned between a lower support downstream of the sealing assembly and a setting shoulder upstream of the sealing assembly. The sealing assembly may be activated from a deactivated state to a sealing state by causing the setting shoulder and the lower support to apply a compressive force to the sealing assembly such that an elastomeric seal extrudes outward into sealing engagement with an inner surface of a tubular. The lower support may comprise a series of expandable segments mounted by a frangible connection, such that, as the compressive force is applied, the expandable segments break away from the lower support and move outward into engagement with the inner surface of the tubular.

According to an aspect, the downhole plug may include one or more of the following features: the elastomeric seal may comprise two or more elastomeric seals having different durometers; each expandable segment may have an outer face that engages the inner surface of the tubular, an upper face oriented toward the setting shoulder that engages an anti-extrusion ring of the sealing assembly, and a lower face opposite the upper face that engages a sloped support surface of the lower support, wherein an angle of the outer face relative to the lower face is such that, as the expandable segments break away from the lower support, the lower face engages and moves along the sloped support surface until the outer face is flush with the inner surface of the tubular; the lower face may be angled downstream moving radially outward, and the upper face of each expandable segment is angled upstream moving radially outward; and the series of expandable segments may be mounted to a mounting ring or are integrally formed with the lower support.

According to an aspect, there is provided a downhole plug, comprising an inner mandrel and a sealing mechanism carried on and surrounding an outer surface of the inner mandrel. The sealing mechanism comprises a lower support; an anti-extrusion ring adjacent to and upstream of the lower support, the anti-extrusion ring being made from a flexible, non-elastomeric material; a robust elastomer and an energizing elastomer upstream of the anti-extrusion ring, the robust elastomer being disposed between the energizing elastomer and the anti-extrusion ring, and the robust elastomer having a higher durometer than the energizing elastomer, the robust elastomer extending upstream toward an outer edge of the robust elastomer such that a portion of the robust elastomer overlies a portion of the energizing elastomer; and a setting shoulder upstream of the energizing elastomer. The sealing mechanism may be activated from a deactivated state to a sealing state by causing the setting shoulder and the lower support to apply a compressive force to the robust elastomer and the energizing elastomer such that the robust elastomer and the energizing elastomer extrude outward into sealing engagement with an inner surface of a tubular.

According to an aspect, the downhole plug may include one or more of the following features: the lower support may comprise a series of expandable segments mounted by a frangible connection, such that, as the compressive force is applied, the expandable segments break away from the lower support and move outward into engagement with the inner surface of the tubular; each expandable segment has an outer face that engages the inner surface of the tubular, an upper face oriented toward the setting shoulder that engages an anti-extrusion ring of the sealing mechanism, and a lower face opposite the upper face that engages a sloped support surface of the lower support, wherein an angle of the outer face relative to the lower face is such that, as the expandable segments break away from the lower support, the lower face engages and moves along the sloped support surface until the outer face is flush with the inner surface of the tubular; and the lower face may be angled downstream moving radially outward, and the upper face of each expandable segment is angled upstream moving radially outward.

According to an aspect, there is provided a slip assembly for a downhole plug, comprising a body comprising a plurality of slip segments connected by a frangible web. Each slip segment comprises an outer engagement surface that define an outer cylindrical surface. The body defines an inner tapered surface that has a larger diameter at an upstream end of the body and a smaller diameter at a downstream end. The frangible web comprises a portion of the inner tapered surface between adjacent slip segments at the upstream end of the body. The slip segments are separated by pushing the inner tapered surface axially against a ramp surface such that the frangible web fractures and such that the fractured frangible web extends across a portion of a space between adjacent slip segments. The frangible web may have a length that is shorter than a length of the body.

According to an aspect, there is provided a downhole plug, comprising a mandrel body and a seal assembly. The mandrel body comprises a first mandrel segment having a first set of threads; a second mandrel segment having a second set of threads that are sized to threadably engage the first set of threads; an outer mandrel surface defined by the first mandrel segment and the second mandrel segment when the first set of threads and the second set of threads are threadably engaged in a threaded connection; an upper shoulder carried by the first segment; and a lower shoulder carried by the second segment. The seal assembly is carried by the mandrel body between the upper shoulder and the lower shoulder, the seal assembly being activatable from a deactivated state to a sealed state at a sealing location on the outer mandrel surface, wherein the threaded connection is positioned downstream of the sealing location such that, with upstream pressure applied, a top end of the threaded connection is at or below a lower edge of the sealing location in an axial direction.

According to an aspect, the downhole plug may include one or more of the following features: each of the first mandrel segment and the second mandrel segment may have an inner surface that defines a flow passage, an inner diameter of the first mandrel segment being less than an inner diameter of the second mandrel segment; the first set of threads may be a box connection and the second set of threads may be a pin connection, the box connection having a lower end that receives the pin connection, the lower shoulder being below the seal assembly in the sealed state; the mandrel body may shift axially to a pressurized position when sufficient upstream pressure is applied, the sealing location being defined relative to the mandrel body in the pressurized position; the top end of the threaded connection may be defined by a reduced sidewall thickness of the first mandrel segment.

According to an aspect, there is provided a downhole tool comprising a setting tool comprising a setting tool sleeve that surrounds a setting tool mandrel, an inner surface of the setting tool sleeve and an outer surface of the setting tool mandrel defining an annular space; a plug mounted below the setting tool; and a ball cage that retains a ball. The plug comprises a plug mandrel having a top end connected to a bottom end of the setting tool mandrel by a shearable connection, the plug mandrel defining a lower fluid passage from a bottom end of the plug mandrel to a ball seat adjacent to the top end of the plug mandrel. A seal assembly is carried on an outer surface of the plug mandrel, the seal assembly being actuatable from a collapsed state to an expanded state. The ball cage is defined by a bottom end of the setting tool mandrel and a top end of the plug mandrel. The ball cage comprises a top flow port in fluid communication with the annular space of the setting tool above the ball, and the ball seat below the ball. In response to a setting force, the setting sleeve moves axially downward relative to the setting tool mandrel to activate the seal assembly into a sealing state, whereupon a further setting force causes the shearable connection to shear such that the bottom end of the setting tool separates from the top end of the plug mandrel, the top flow port equalizing pressure above the ball such that the ball remains adjacent to the ball seat.

Other aspects will be apparent from specification and drawings.

BRIEF DESCRIPTION OF THE DRAWINGS

These and other features will become more apparent from the following description in which reference is made to the appended drawings, the drawings are for the purpose of illustration only and are not intended to be in any way limiting, wherein:

FIG. 17 is a perspective view of an upper mandrel section.

FIG. 18 is a perspective view of a lower mandrel section.

FIG. 19 is an exploded view of a mandrel.

FIG. 20 is an exploded view in section of the mandrel.

DETAILED DESCRIPTION OF PREFERRED EMBODIMENTS

Figure 1:
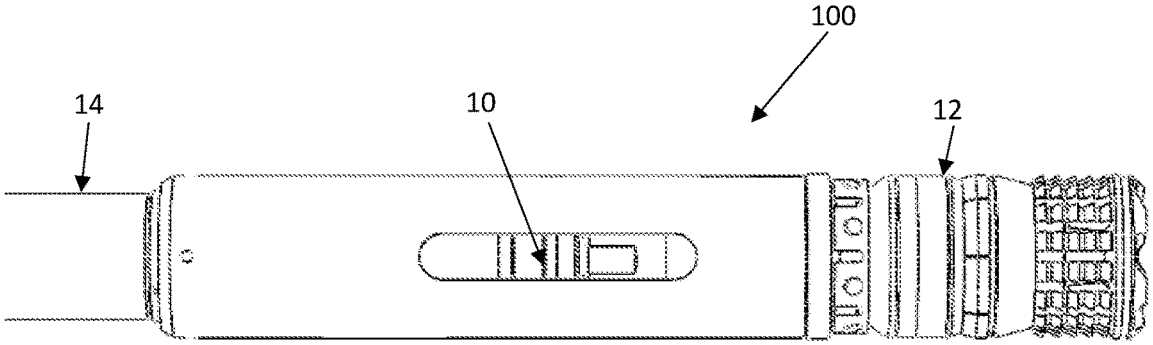
FIG. 1 is a side elevation view of a wireline adapter kit attached to a downhole plug.
Figure 2:
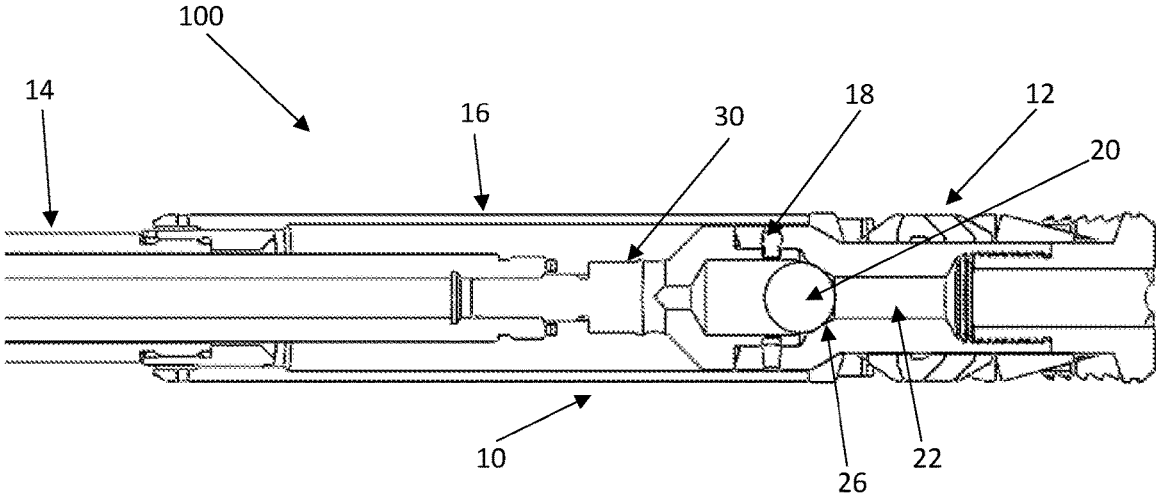
FIG. 2 is a side elevation view in section of the wireline adapter kit attached to the downhole plug.

Referring to FIGS. 1 and 2, there is shown a system 100 that includes a downhole plug 12 and a wireline adapter kit ("WLAK") 10 that allows plug 12 to be run in on a wireline system. System 100 may be adapted to allow plug 12 to be run on other conveyances, such as continuous tubing. System 100 may be considered to include an adapter kit 10 that is specific to a particular plug 12 design, and a setting tool 14 that applies the setting force used to set plug 12. WLAK 10 is run downhole into the well attached to plug 12 to the desired depth. A setting sleeve 16 may then be stroked forward on a piston mechanism. A tension mandrel 30 may be attached to plug 12 by shear pins 18, which hold plug 12 in place as plug 12 is set. Once setting sleeve 16 has stroked forward sufficiently, a further application of force will cause shear pins 18 to shear, thus detaching plug 12 in the set position. The number and strength of shear pins 18 may be selected to ensure that the anchoring and sealing components of plug 12 are set generating prior to detaching WLAK from plug 12. Plug 12 will be described in terms of a casing string during a hydraulic fracturing operation, however it will be understood that plug 12 may be installed in any suitable tubing string for other operations.

Figure 3:
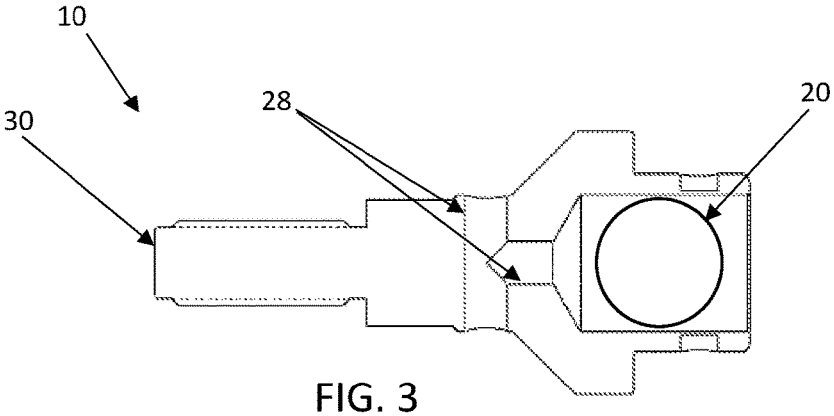
FIG. 3 is a detailed side elevation view in section of a frac ball carried by a tension mandrel of the wireline adapter kit.

In the depicted example, referring to FIG. 2, a ball 20 is carried by WLAK 10, sometimes referred to as a caged ball or ball-in-place design. As shown in FIG. 3, ball 20 may be carried in a tension mandrel 30 of WLAK 10. Referring again to FIG. 2, ball 20 acts as a type of check valve, allowing plug 12 to be run in during installation, and then sealing a fluid passage 22 from up-hole pressure once plug 12 has been installed. During installation, fluid may flow up through fluid passage 22 of the frac plug 12, and may lift ball 20 off a ball seat 26, allowing fluid to pass more quickly past plug 12. This may be useful if plug 12 is designed to fit closely within a tubing string, such that, while flow around plug 12 is possible, the flow area may be restricted and may slow the descent of plug 12. With ball 20 lifted from ball seat 26, fluid is able to pass through and/or past WLAK 10. Once plug 12 is properly positioned, and set it is important for ball 20 to engage ball seat 26 in order to seal against up-hole pressure applied from above. Referring to FIG. 3, to reduce the likelihood that ball 20 will become hydraulically stuck or locked in WLAK 10, flow paths 28 may be machined into tension mandrel 30 to equalize pressure during deployment as shown.

Sealing Elastomer and Anti-Extrusion Ring

The term "elastomer" is used herein to refer to natural elastomers, synthetic elastomers, or suitable blends that may be suitable for sealing in any given environment.

Figure 4:
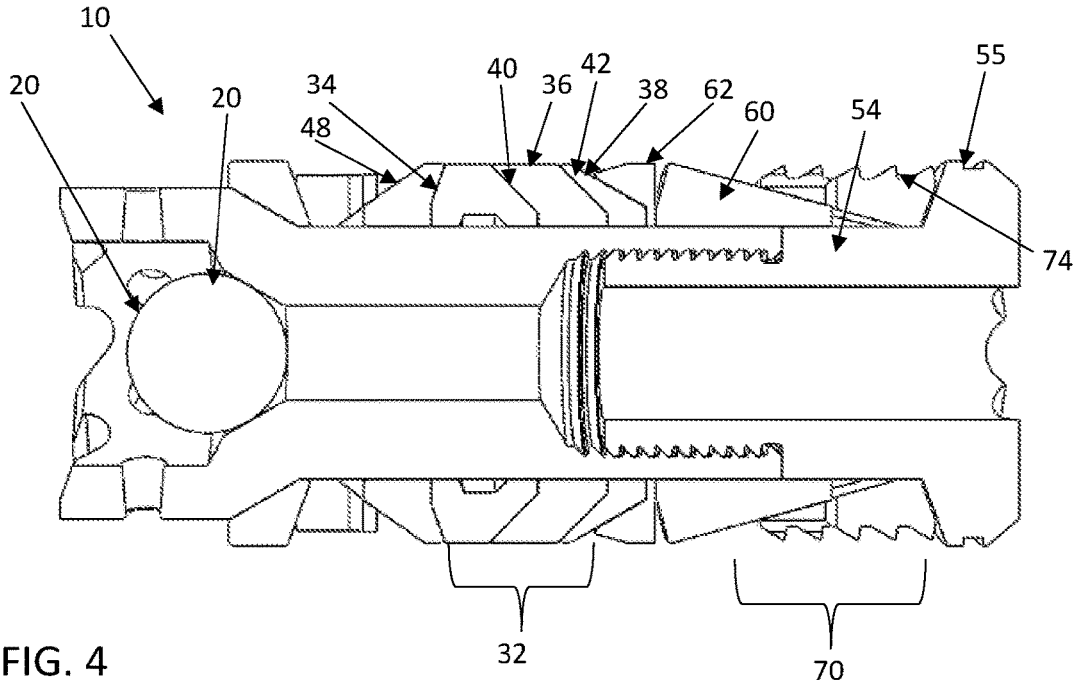
FIG. 4 is a side elevation view in section of a downhole plug.
Figure 5:
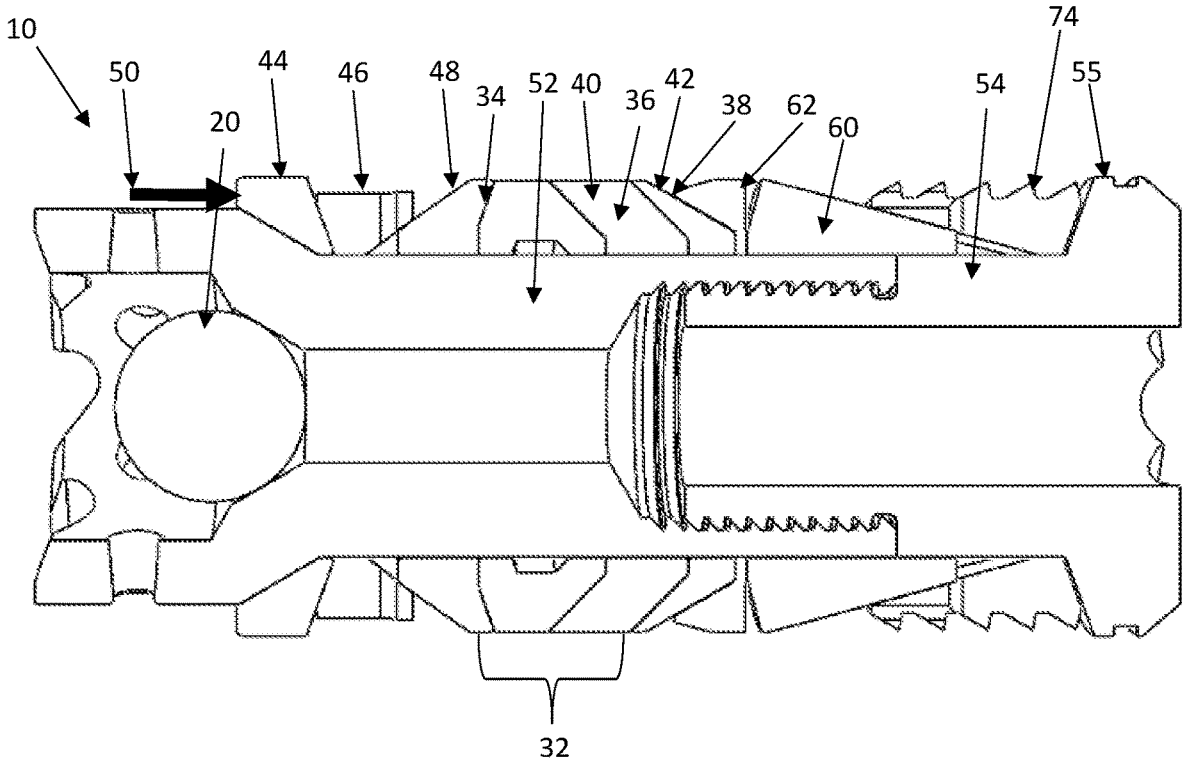
FIG. 5 is a side elevation view in section of the downhole plug showing the direction of an applied a setting force.

Referring to FIG. 4, a sealing mechanism 32 is carried on an outer surface of a mandrel 52. Referring to FIG. 5, a setting force may be applied to sealing mechanism 32, that causes the elastomers in sealing mechanism 32 to extrude in the directions identified in FIG. 6 during the setting process outward to form a seal against the tubing string 35 in which the plug 12 is deployed. Referring to FIG. 4, sealing mechanism 32 includes three main components: an energizer elastomer 34, a robust elastomer 36, and an anti-extrusion ring 38. The elastomeric portion of sealing mechanism 32 is made up of energizer elastomer 34 and robust elastomer 36, which may be different types of elastomer and which may have different durometers that are designed to improve the ability to seal against a tubing string and reliably hold high amounts of pressure. In one example, a test model was able to hold pressures greater than 16,500 psi.

When plug 12 is set, the elastomeric components are compressed such that energizer elastomer 34 and robust elastomer 36 extrude outwards and engage the inner wall of a well casing to provide the seal. Energizer elastomer 34 may be made from a lower durometer elastomer relative to robust elastomer 36, and the cross-sectional profile of energizer elastomer 34 may be designed to promote outward growth of energizer elastomer 34, and to stabilize it in the sealing state. This outward growth is transferred to robust elastomer 36 to urge it "flare" out to the casing. Robust elastomer 36 may be made from a higher durometer elastomer relative to energizer elastomer 34, making it more robust. In addition, its profile may be designed to match the designed profile of energizer elastomer 34, which also helps it flare outwards tubing string 35 casing and form a seal. The designed profiles may be made to reduce an amount of elastomer required, which helps keep plug 12 shorter and reduces the amount of elastomeric material that may need to be drilled out after the operation is complete. For example, energizer rubber 34 may taper from a larger base to a narrower outer surface, and robust elastomer 36 may have an upstream-facing surface 40 that overlies the tapered surface of the energizer rubber. A downstream-facing surface 42 of robust rubber 36 may be sloped in the same direction, but not necessarily at the same angle, as upstream-facing surface 40, and anti-extrusion ring 38 may overlie the downstream-facing surface.

Anti-extrusion ring 38 is a flexible ring of material that extrudes outwards alongside the elastomer components mentioned above. Anti-extrusion ring 38 is flexible but may not be made of elastomer as elastomers tend to act as a fluid at high pressures. This means that an elastomer under sufficient pressure will tend to extrude through any opening. In this design, the elastomer is contained by anti-extrusion ring 38, which is designed fill openings in plug components that are downstream of the elastomer components, such as petals 62 of a lower cone 60. As petals 62 expand, small gaps between individual petals 62 may be formed through which an elastomeric material may otherwise extrude. The flexible anti-extrusion ring 38 fills these gaps and prevents such an extrusion from occurring. Suitable materials may include nylon- or Teflon-based materials, which are sufficiently flexible, and may allow for plastic deformation, in order to fill the gaps and prevent extrusion therethrough. Other materials may include brass or bronze for high temperature applications.

There may be setting components upstream of energizer elastomer 34 that allow the setting force to be applied to the elastomers and other components. In the depicted example, these may include an upper load ring 44 that interacts with the setting tool, a set of upper slips 46 below load ring 44, and an upper cone 48 below upper slips 46 and above energizer elastomer 34. Upper cone 48 forces upper slips 46 into engagement with the inner surface of tubing string 35. Other plug 12 configurations that may include other components or fewer components are also possible. During use, a force 50 may be applied to the load ring, which moves axially along an inner mandrel 52 of plug 12 relative to a bottom shoulder 55 of inner mandrel 52. The slope of this engagement on the upstream side of energizer elastomer 34 may be closer to the radial direction relative to the slope on the downstream side of energizer elastomer 34. As depicted, plug 12 is designed to withstand fluid pressure 102 against an upstream side of sealing mechanism 32, the extrusion that results from fluid pressure 102 will typically occur in a downstream direction. As such, the components upstream of the elastomer may be primarily designed to ensure the seals are properly set.

Petal Anti-Extrusion Design: Shear Wedge

Figure 6:
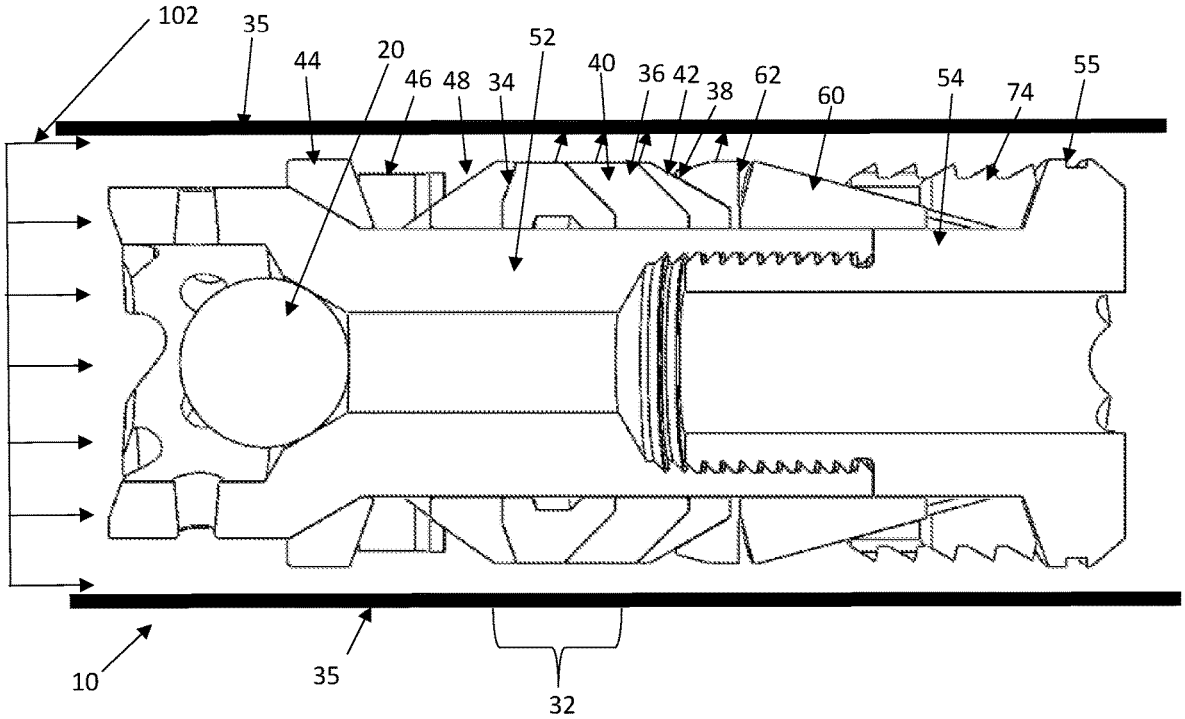
FIG. 6 is a side elevation view in section of the downhole plug in a casing string and showing the pressures applied as a result of the setting force.
Figure 7:
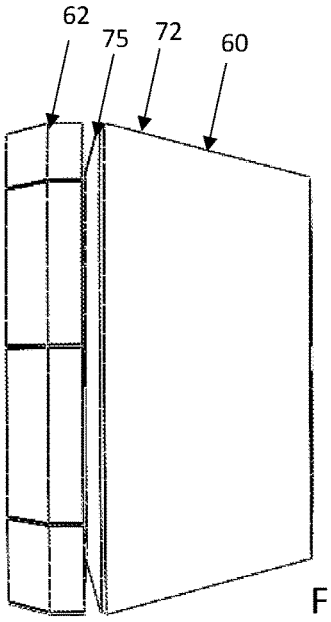
FIG. 7 is a side elevation view of a lower cone of the downhole plug.
Figure 8:
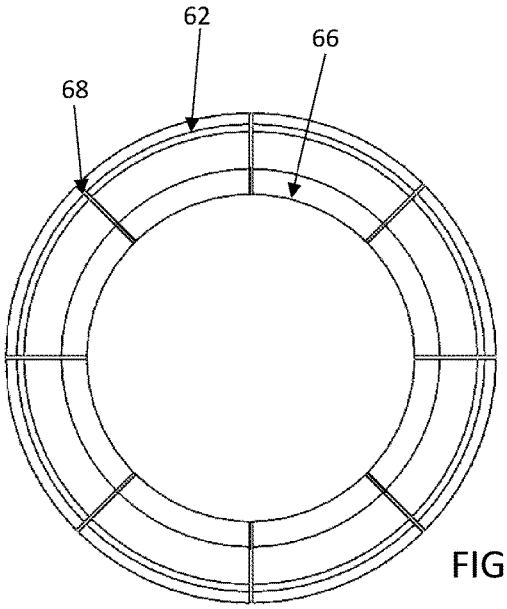
FIG. 8 is a front elevation view of the lower cone.
Figure 10:
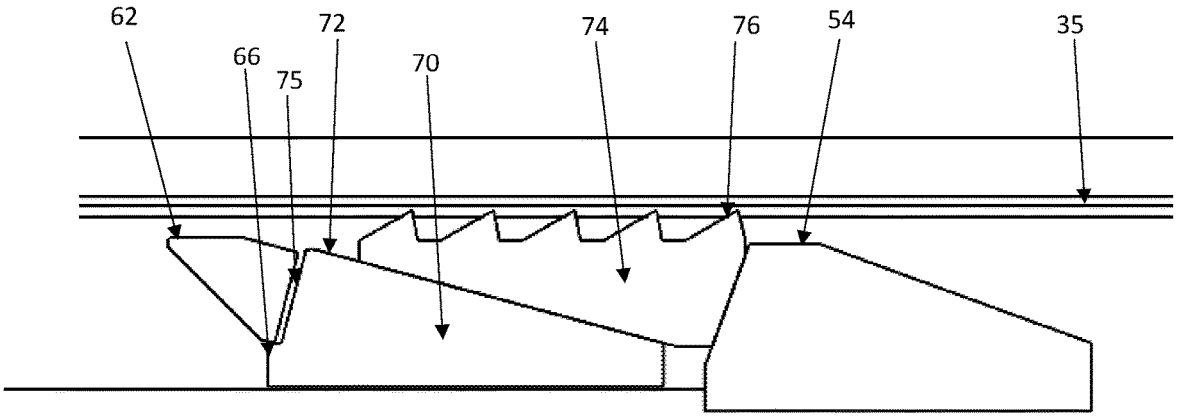
FIG. 10 is a detailed side elevation in section of the lower cone and slips in a partially activated state.
Figure 11:
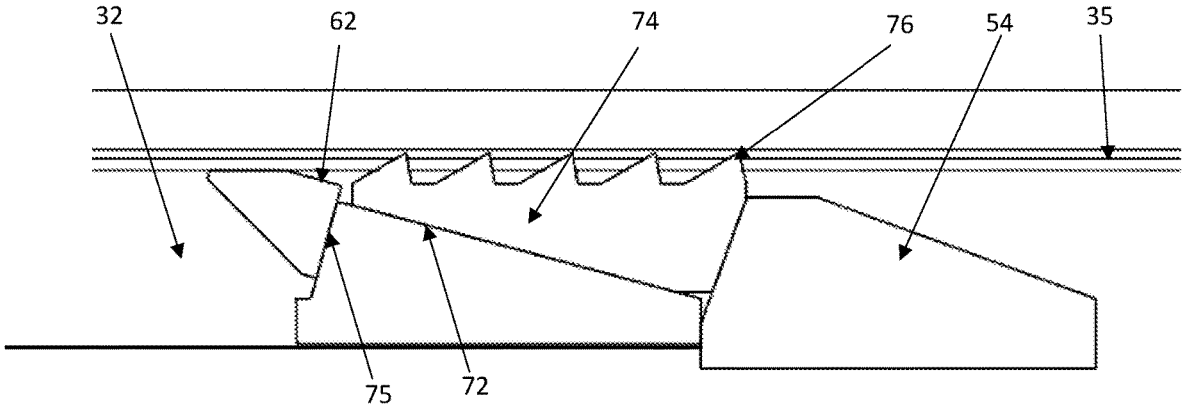
FIG. 11 is a detailed side elevation in section of the backup ring, lower cone and slips in an activated state.
Figure 12:
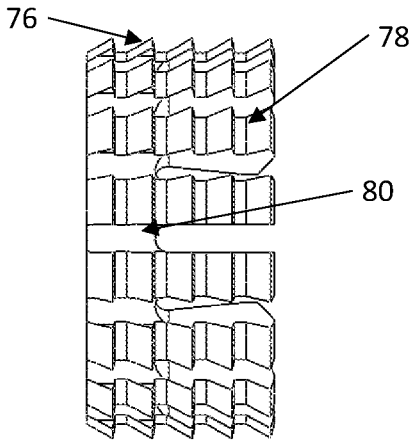
FIG. 12 is a side elevation view of the slips.
Figure 13:
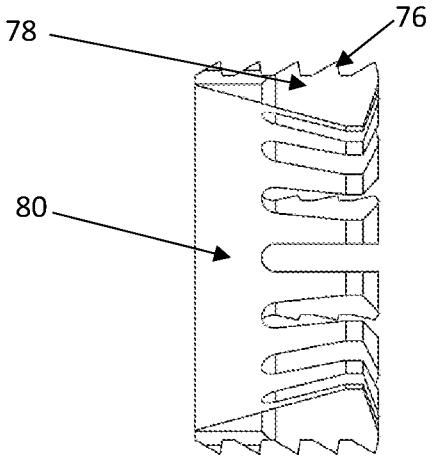
FIG. 13 is a side elevation view in section of the slips.
Figure 14:
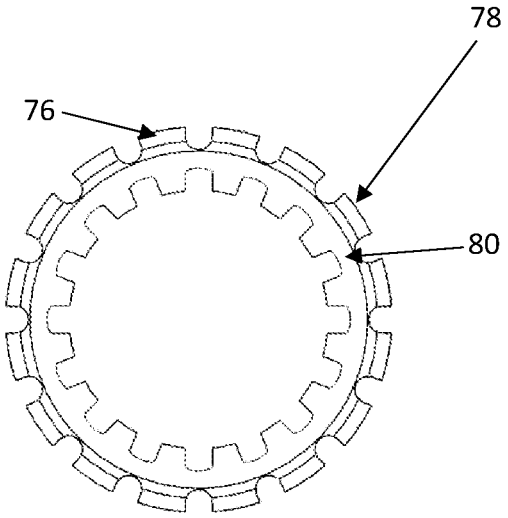
FIG. 14 is a front elevation view of the slips.
Figure 15:
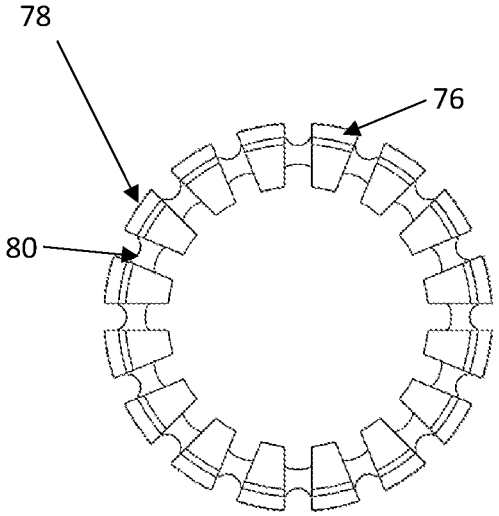
FIG. 15 is a rear elevation view of the slips.

As noted above, expanding petals 62 are positioned between the lower portion of plug 12, which includes anchoring mechanism 70, and the elastomers in sealing mechanism 32. Petals 62 positioned on lower cone 60 are shown in FIGS. 7 and 8. Referring to FIGS. 10 and 11, petals 62 are designed to flare outwards as plug 12 is set to help support sealing mechanism 32. Referring to FIG. 4-6, in addition to providing some structural support for sealing mechanism 32, petals 62 help support the anti-extrusion ring 38 to prevent extrusion of the elastomers under pressure, such that the elastomers and flexible anti-extrusion ring 38 will not flow through a gap between the outer edge of plug 12 when set and the inner wall of tubing string 35. As this gap may be a point of failure, a higher degree of protection at this gap may increase the reliability of plug 12.

As depicted in FIG. 4-6, petals 62 are carried by a mounting ring 66. Petals 62 and mounting ring 66 and may be machined from a common piece of material. In some examples, petals 62, mounting ring 66, and lower cone 60 may be formed as a single piece or as separate pieces. In another example, petals 62 may be machined directly from lower cone 60, such that mounting ring 66 is not required. Petals 62 may be designed as an expandable outer portion that extends out from mounting ring 66, which is installed over inner mandrel 52 of plug 12. Referring to FIGS. 7 and 8, petals 62 are separate components, either by machining a gap 68 (preferably as narrow as practical) or by providing a frangible connection between adjacent petals 62. Petals 62 are designed to shear or break away from the mounting at relatively low force (i.e. before the elastomer are fully set). Once petals 62 break away, they follow the flaring out of sealing mechanism 32 and provide a solid wedge between sealing mechanism 32, the lower components, and the inner wall of tubing string 35 as shown in FIG. 11. The geometry of petal 62 has a generally wedge-shaped body that tapers in an axial direction from a wider outer edge to a narrower inner edge. Petal 62 also tapers from a wider leading surface facing sealing mechanism 32 toward a narrower trailing surface toward lower slips 74. The outer surface of petals 62 may be angled such that, as petal 62 breaks away, rotates, and is pressed outward along the ramped upper surface 75 of lower cone 60, the outer surface is parallel to the inner surface of tubing string 35. In this manner, petal 62 acts as a wedge that is relatively thick and has a geometry that allows it to be supported by an underlying surface on a downstream side and tubing string 35 against the outer surface, while providing a surface that slopes forward to support anti-extrusion ring 38. This provides effective protection against extrusion of sealing mechanism 32. By increasing the surface area of petals 62 that is engaged by casing string 35 and lower cone 60, the load is more distributed such that point stresses are reduced. This may be beneficial when petals 62 are made from brittle materials such as a composite or dissolvable materials that may be used in some downhole plugs.

While anti-extrusion petals 62 are described in terms of a downhole plug, this design may find application in other applications to prevent extrusion of a seal under high pressure, such as in a packer element.

Anchoring Mechanism: Lower Slips

Referring to FIG. 4-6, an anchoring mechanism 70 is located downstream of expanding petals 62. As shown, an upstream end of lower cone 60 of anchoring mechanism 70 has a surface that engages and supports petals 62 and that holds mounting ring 66 in place to allow petals 62 to shear.

Figure 9:
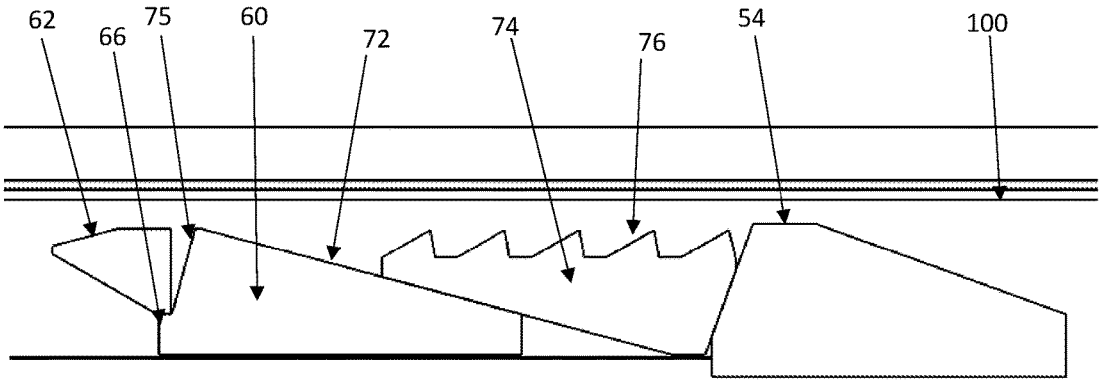
FIG. 9 is a detailed side elevation in section of a backup ring, the lower cone, and slips.

Anchoring mechanism 70 is designed to provide mechanical strength that holds plug 12 in place against the build-up of pressure being held by sealing mechanism 32. Referring to FIG. 9-11, anchoring mechanism 70 includes lower cone 60 that has a ramp 72 and a lower slip 74. When plug 12 is activated, lower slip 74 moves along ramp 72 to engage the inner surface of tubing string 35. Lower slip 74 may be designed with an engagement surface 76, such as serrated teeth on its outer surface, that may be made from a suitable material and may be hardened, such as by heat treatment, to provide a desired amount of mechanical strength, which may also be achieved by allowing the serrated teeth to bite into tubing string 35 to anchor plug 12.

Lower slip 74 anchors plug 12, and may be designed to facilitate being drilled out. Once the pressure operation has been completed, plugs 12 must be removed so the well can begin producing oil and/or gas. This is often done by drilling them out, such as by using an auger-like mud motor with a drill bit that drills through each plug 12. The material of lower slip 74, typically metal given the operational requirements, must be hard enough to anchor the product, but still be able to be broken up by the drill bit while minimizing unnecessary damage to the drill bit. Typically, the drill bit used to drill out plugs 12 has an outer diameter only slightly smaller than the inner diameter of tubing string 35. This places a practical limit on the size of the pieces that plug 12 must break up to allow them to flow past the drill bit and out of the well. The smaller the pieces, the more debris is removed out of the way and the lower the chance of the mud motor getting stuck. In addition, in order to facilitate breaking up lower slip 74 into as small of pieces as possible, it is beneficial to reduce the amount of material that breaks up without causing any support issues. Another consideration regarding removing material of lower slip 74 is how lower slip 74 supports lower cone 60. Lower cone 60 may be made up of composite material which may have less material strength than lower slip 74, which may be made from metal such as cast iron. Lower cone 60 may also be made of other materials, such as metals or dissolvable materials. The present design aspects may be particularly useful where lower cone 60 is made from a relatively weak material. If there is insufficient contact area between lower slip 74 and lower cone 60, lower slip 74 will begin to dig in and potentially crush lower cone 60, which would cause plug 12 to fail. Plug 12 may be designed to balance anchoring mechanism 70 while reducing the amount of material to create easier drill outs and also supporting lower cone 60 so it will not be damaged.

In designing a slip 74 that bites sufficiently into tubing string 35, it may be desirable to avoid excessive damage caused by lower slip 74 to the tubing string 35, which may affect future operations. This may be mitigated by increasing the contact area between lower 74 slip and the inner wall of tubing string 35 to help spread out the force. For example, the number of serrated teeth may be increased, which decreases the size of bite that each tooth will make.

Referring to FIG. 12-15, lower slip 74 may be designed with multiple segments 78 that break apart as plug 12 is set. Appropriate material selection may be used to ensure a connecting web 80 between slip segments 78 breaks as lower slip 74 expands. For example, selection of a material with a lower elongation increases the likelihood connecting web 80 will fracture appropriately and break up lower slip 74 into individual segments. Breaking lower slip 74 into segments may have certain benefits. First, it may help to distribute the load more evenly around the circumference of plug 12 to provide a more desirable anchoring force. Second, it helps to provide support for petals 62 discussed above. The geometry of slip segments 78 may be designed to encourage lower slip 74 to get close to petals 62 as an additional layer of protection against extrusion, as shown in FIG. 11. In addition, causing lower slip 74 to break into individual segments 78 may be desirable for drill outs, as smaller pieces are easier to break up and flow back.

As noted above, referring to FIG. 12-15, lower slip 74 may be designed with a frangible, connecting web 80 between adjacent slip segments. As shown, the connecting web is in a plane that is parallel to the inner surface. Connecting web 80 may be formed by machining away sufficient material from a solid body to ensure the slip segments 78 separate appropriately, while leaving sufficient material to reduce the risk that connecting web 80 will fracture prematurely. At the same time, slip segments 78 are preferably wide enough to provide sufficient surface area to distribute the engagement force against the casing.

To reduce the amount of material in the lower slip 74, the material may be machined out of the thicker end of lower slip 74. It may be desirable to have the slips "break" upon setting on the top side, as mentioned the smaller the gaps the better the anti-extrusion.

Two-Piece Mandrel

Figure 16A:
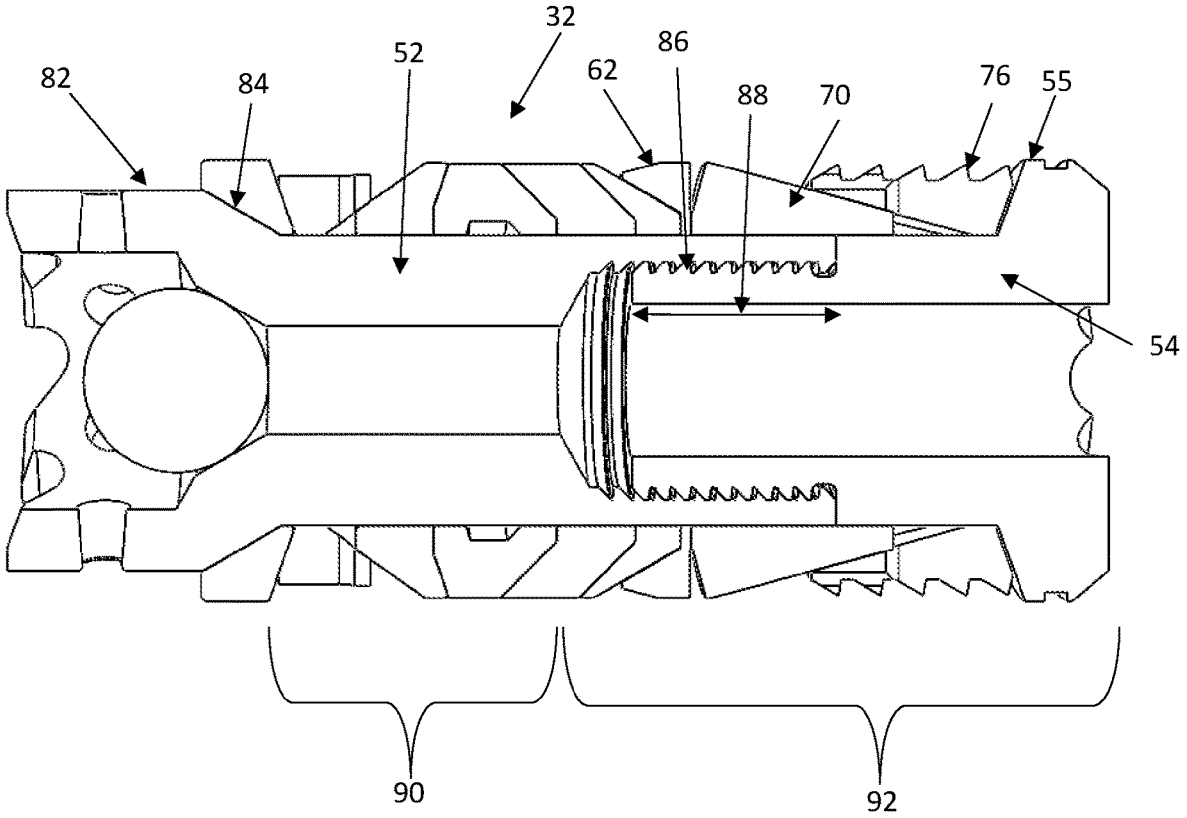
FIG. 16*a* is a side elevation view in section of an internally threaded mandrel.
Figure 16B:
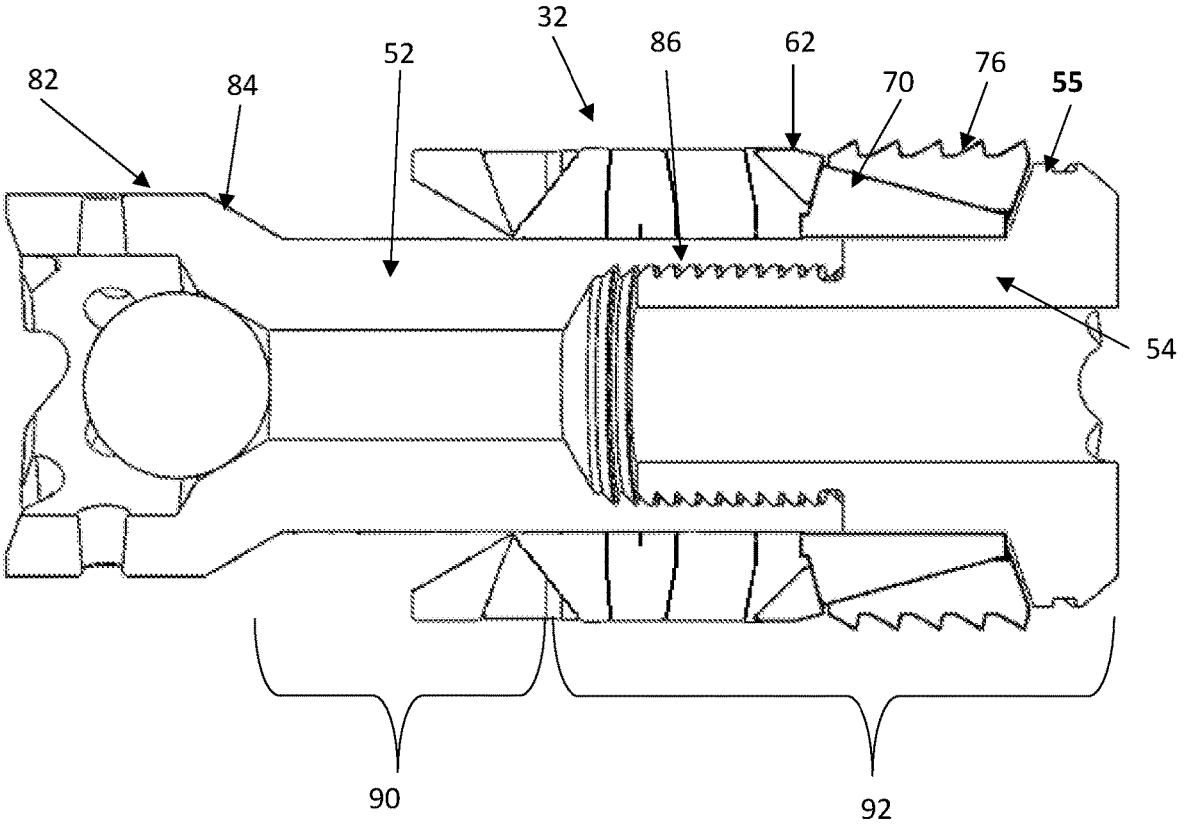
FIG. 16*b* is a side elevation view in section of the internally threaded mandrel with the seals in a set position.

Referring to FIGS. 16*a* and 16*b*, when the plug is assembled, the exterior components are placed onto inner mandrel 52 of plug 12 in order until they are shouldered out against a bearing face 84 of an upper mandrel 82. Lower mandrel 54 is installed to secure the components in place and hold them in place during shipping and deployment. This connection must be strong enough to hold against the setting force applied to the exterior components during the setting operation so the plug can function as intended. Inner mandrel 52 must be sufficiently thick and the connection between upper mandrel 82 and lower mandrel 54 sections must be sufficiently strong to ensure plug 12 is able to withstand the setting force and any differential pressure that may be applied across plug 12 during a downhole fracturing operation, which is of particular concern if mandrel 52 is made from a composite material rather than metal. The depicted example is designed such that the connection does not experience the differential pressure once the seals have been set, as shown in FIG. 16*b*.

The differential pressure across plug 12 applies a force that could collapse mandrel 52 inwards if the cross section is not strong enough. The strength may be increased by increasing the wall thickness. With respect to the differential pressure, the portion of mandrel 52 that is of particular concern is adjacent to sealing mechanism 32, which holds the frac pressure, and not below sealing mechanism 32. This means that an exposed region 90 of the mandrel is at or above sealing mechanism 32. As such, the sheltered section 92 of mandrel 52 that is below sealing mechanism 32 when set (i.e. with sealing mechanism 32 compressed toward bottom support shoulder 55) may have a smaller cross-sectional area as it will be exposed to a reduced collapsing pressure due to the pressure differential, and must only be sufficient to withstand the force as a result of the plug being set at a minimum. 4This may result in the upstream section of mandrel 52 having a smaller inner diameter than the downstream section of mandrel 52. The pressure acting on plug 12 below sealing mechanism 32 is the formation pressure, which is equalized as it applies inside and outside of plug 12. As previously stated, the shorter and/or less material plug 12 contains, the less debris there is to be drilled out and circulated out of the well.

Mandrel 52 of plug 12 may be made from a composite material that is manufactured in layers of woven material that are epoxied together, such as sheets of woven material that are wrapped around a mandrel with layers of epoxy between each woven layer and built up to the desired diameter. It has been found that these layers of woven material and epoxy are stronger than threads that are machined into the part. This means that the natural layers of the material provide more shear strength than threads machined into the mandrel along the same length.

Due to the manufacturing process of the material, each "tube" of composite woven material typically comes in tubes that are between 42 to 48 inches long. In order to keep material costs down, it is desirable to minimize waste, by machining as many mandrels as possible from each tube of composite. By making a shorter mandrel, more mandrels can be manufactured from each tube, thus eliminating waste. Furthermore, with compression molding of composites, it is also desirable to keep the parts as short as possible. The manufacturing process for compression molding becomes more difficult with large volumes of material and over longer lengths. This means, the shorter the mandrel, the more efficient or cost-effective the process may be for compression molding as well.

In order to take advantage of the above observations, mandrel 52 may be made with upper mandrel 82 and lower mandrel 54. In addition, a threaded connection 86 may be embedded within upper mandrel 82 at a location that is not subject to collapse pressure. In particular, threaded connection 86 may be axially downstream relative to the location of sealing mechanism 32, and upstream of the support shoulder of the lower mandrel 54. As the shear strength of the composite material is stronger than the shear strength of a threaded connection, placing threaded connection 86 upstream of the support shoulder 55 of lower mandrel 54, the support shoulder may be shorter than would be the case if the support shoulder were threaded onto mandrel 52. At the same time, by positioning threaded connection 86 at an intermediate position within the body of mandrel 52, mandrel 52 allows for a longer threaded connection 86 without affecting the length of mandrel 52 as a whole. This may be referred to as a negative length 88, as it is length that holds the plug together, but does not increase the length of the mandrel or the product as a whole. Details of mandrel 52 and threaded connection 86 are shown in FIG. 17-20.

During operation, when plug 12 is set, sealing mechanism 32 will be compressed toward the bottom shoulder 55 of mandrel 52. The components of sealing mechanism 32 may be positioned upstream of the lower end of the upper mandrel 82 that receives lower mandrel 54 to prevent pressurized fluid from passing along threaded connection 86 when pressure is applied. In addition, as pressure is applied upstream of plug 12, such as during a fracturing operation, the top end of mandrel 52 (sealed by ball 20) may be shifted downstream relative to seal assembly 32, causing threaded connection 86 to shift relative to seal assembly 32. Since the strength of mandrel 52 will be of particular importance under higher pressures, threaded connection 86 should start at the bottom edge of seal assembly 32 or lower when seal assembly 32 is in the compressed, set state, and after mandrel 52 has been shifted down. For example, the upper end of threaded connection 86 may overlap with, or extend above seal assembly 32 in the set state but before the operation pressures have been applied, provided that threaded connection 86 is sealed against leaks, and provided that, once pressure is applied and mandrel 52 shifts, threaded connection 86 is properly sheltered against pressure in a radial direction which may be applied directly against mandrel 52 by the fluid pressure, or via the elastomeric seals. The upper end of threaded connection 86 may be interpreted as the point at which the wall thickness of upper mandrel 82 is reduced, whether the threads start at that point or not.

In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The scope of the following claims should not be limited by the preferred embodiments set forth in the examples above and in the drawings, but should be given the broadest interpretation consistent with the description as a whole.

What is claimed is:

1. A downhole plug, comprising:

a mandrel body comprising;

a first mandrel segment having a first set of threads;

a second mandrel segment having a second set of threads that are sized to threadably engage the first set of threads;

an outer mandrel surface defined by the first mandrel segment and the second mandrel segment when the first set of threads and the second set of threads are threadably engaged in a threaded connection;

an upper shoulder carried by the first mandrel segment; and a lower shoulder carried by the second mandrel segment at a fixed distance relative to the upper shoulder; and a load ring carried by the mandrel body;

a seal assembly carried by the mandrel body between the upper shoulder and the lower shoulder, the load ring being moveable relative to the mandrel body, the seal assembly being activatable from a deactivated state to a sealed state at a sealing location on the outer mandrel surface by applying a force to move the load ring along the mandrel body toward the lower shoulder, wherein the threaded connection is positioned downstream of the sealing location such that, with upstream pressure applied, a top end of the threaded connection is at or below a lower edge of the sealing location in an axial direction.

2. The downhole plug of claim 1, wherein the first mandrel segment and the second mandrel segment each have an inner surface that defines a flow passage, an inner diameter of the first mandrel segment being less than an inner diameter of the second mandrel segment.

3. The downhole plug of claim 1, wherein the first set of threads are a box connection and the second set of threads are a pin connection, the box connection having a lower end that receives the pin connection, the lower shoulder being below the seal assembly in the sealed state.

4. The downhole plug of claim 1, wherein the mandrel body shifts axially to a pressurized position when sufficient upstream pressure is applied, the sealing location being defined relative to the mandrel body in the pressurized position.

5. The downhole plug of claim 1, wherein the top end of the threaded connection is defined by a reduced sidewall thickness of the first mandrel segment.

6. The downhole plug of claim 1, wherein the threaded engagement between the first set of threads and the second set of threads remains unchanged as the plug is activated from the deactivated state to the sealed state.

* * * * *